US005953558A

United States Patent [19]

Patterson et al.

[11] Patent Number: 5,953,558

[45] Date of Patent: Sep. 14, 1999

[54] IMAGING MODULE MOUNTING STRUCTURE

[75] Inventors: James W. Patterson, Newark; Eugene J. Manno, Ontario; Thomas E. Behrendt, Macedon; Stephen C. Corona, Webster; Thomas J. Hammond; Mary F. Krystofik, both of Penfield, all of N.Y.

[73] Assignee: Xerox Corporation, Stamford, Conn.

[21] Appl. No.: 09/159,753

[22] Filed: Sep. 24, 1998

[51] Int. Cl.[6] ..... G03G 21/16

[52] U.S. Cl. ..... 399/107; 399/170

[58] Field of Search ..... 399/107, 220, 399/4, 170–173, 411; 74/10.6, 569

[56] References Cited

U.S. PATENT DOCUMENTS 4,627,701 12/1986 Onoda et al. .

*Primary Examiner*—Richard Moses

*Attorney, Agent, or Firm*—Oliff & Berridge, PLC

[57] ABSTRACT

An imaging module mounting structure is used for mounting an imaging module to an imaging device that has a support member and a rotatable photoreceptor. The imaging module includes an imaging bar and a corona generating device. The imaging module mounting structure includes a pair of pivot block devices which are pivotably connected to the support member in a spaced apart relationship. The imaging bar and the corona generating device are secured to each one of the pair of pivot block devices. Each pivot block device includes a cam follower element. The pair of pivot block devices are operative to flex independently of one another while the photoreceptor rotates so that the respective cam follower elements remain in contact with the rotating photoreceptor to compensate for photoreceptor run out. A method for practicing the present invention is also described.

20 Claims, 7 Drawing Sheets

IMAGING MODULE MOUNTING STRUCTURE

BACKGROUND OF THE INVENTION

1. Field of Invention

The invention is directed to an image module mounting structure that is used for mounting an image module to an imaging device. In particular, the invention relates to an imaging module mounting structure that includes a pair of pivot block devices capable of flexing to compensate for photoreceptor run out.

2. Description of Related Art

Many different types of imaging devices are available in the marketplace. One type of imaging device uses a drum-type photoreceptor and an imaging module that is mounted in close proximity to the drum-type photoreceptor. The imaging module includes the charging and exposure subsystems. Typically, the charging subsystem is a corona generating device such as a scorotron charging device and the exposure subsystem is a conventional light emitting diode imaging bar.

The imaging module is mounted to an imaging module mounting structure. Typically, the imaging module mounting structure is pivotably mounted to a support within the imaging device. The imaging module mounting structure includes a pair of cam followers that are designed to be in contact with opposite ends of the drum-type photoreceptor. However, although the drum-type photoreceptor appears perfectly cylindrical to a human eye, the cross sectional configuration of the photoreceptor is eccentric which is commonly referred to as "photoreceptor run out". Thus, as the photoreceptor rotates about its axis of rotation, the surface of the photoreceptor rises and falls relative to a perfectly circular shape. Generally, photoreceptor run out ranges between plus and minus 0.006 inches.

Photoreceptor run out causes one of the pair of cam followers to intermittently lose contact with the photoreceptor as it rotates. As one of the pair of cam followers loses contact with the surface of the photoreceptor, the focal spacing of the image bar relative to the photoreceptor varies. Also, the relationship of the corona generating device relative to the photoreceptor also becomes distorted. Variable focal spacing and uneven spacing of the corona charging device relative to the photoreceptor result in poor imaging.

Also, it is desirable to maintain a predetermined temperature of the imaging bar. Unstable imaging results occur when the critical temperature of the imaging bar cannot be maintained. Also, without sufficient airflow through the imaging module, the corona charging device can produce ozone which also can be detrimental to the imaging process.

SUMMARY OF THE INVENTION

A first embodiment of the invention includes an imaging module mounting structure that is used for mounting an imaging module to an imaging device. The imaging device includes a support member and a drum-type photoreceptor that is capable of rotating. The imaging module includes an imaging bar and a corona charging device. The imaging module mounting structure includes a pair of pivot block devices that are pivotably connected to the support member in a spaced-apart relationship. The imaging bar and the corona generating device are secured to each one of the pair of pivot block devices. Each pivot block device includes a cam follower element that remains in contact with the rotating photoreceptor as a result of the pair of pivot block devices operative to flex independently of one another while the photoreceptor rotates.

A second embodiment of the invention includes a pivot block device. The pivot block device includes a cam follower assembly, a connector member and a web. The cam follower assembly includes a body member having a first surface, a second surface disposed opposite the first surface and an outer wall. The outer wall extends between the first and second surfaces in a transverse direction and extends circumferentially about the first and second surfaces. The cam follower assembly also includes a cam follower element connected to and projecting from the outer wall. The connector member has an outer connector surface and an inner connector surface that defines a conduit. The web is disposed apart from the cam follower element and interconnects the body member and the connector member at the outer wall surface and the outer connector surface such that the conduit extends in the transverse direction.

Another embodiment of the invention is a method for retaining the imaging module in an imaging device in contact with the photoreceptor as it rotates. The imaging module used includes a pair of spaced apart pivot block devices. The method includes the steps of mounting each one of the pair of pivot block devices to the support member, contacting a photoreceptor surface of the rotating photoreceptor with each one of the pair of pivot block devices and maintaining contact between each one of the pair of pivot block devices and the photoreceptor surface such that each one of the pair of pivot block devices flexes independently of one another as the photoreceptor rotates to compensate for photoreceptor run out.

BRIEF DESCRIPTION OF THE DRAWINGS

Other features of the invention will become apparent as the following description proceeds and upon reference to the drawings, in which.

DETAILED DESCRIPTION OF PREFERRED EMBODIMENTS

Figure 1:
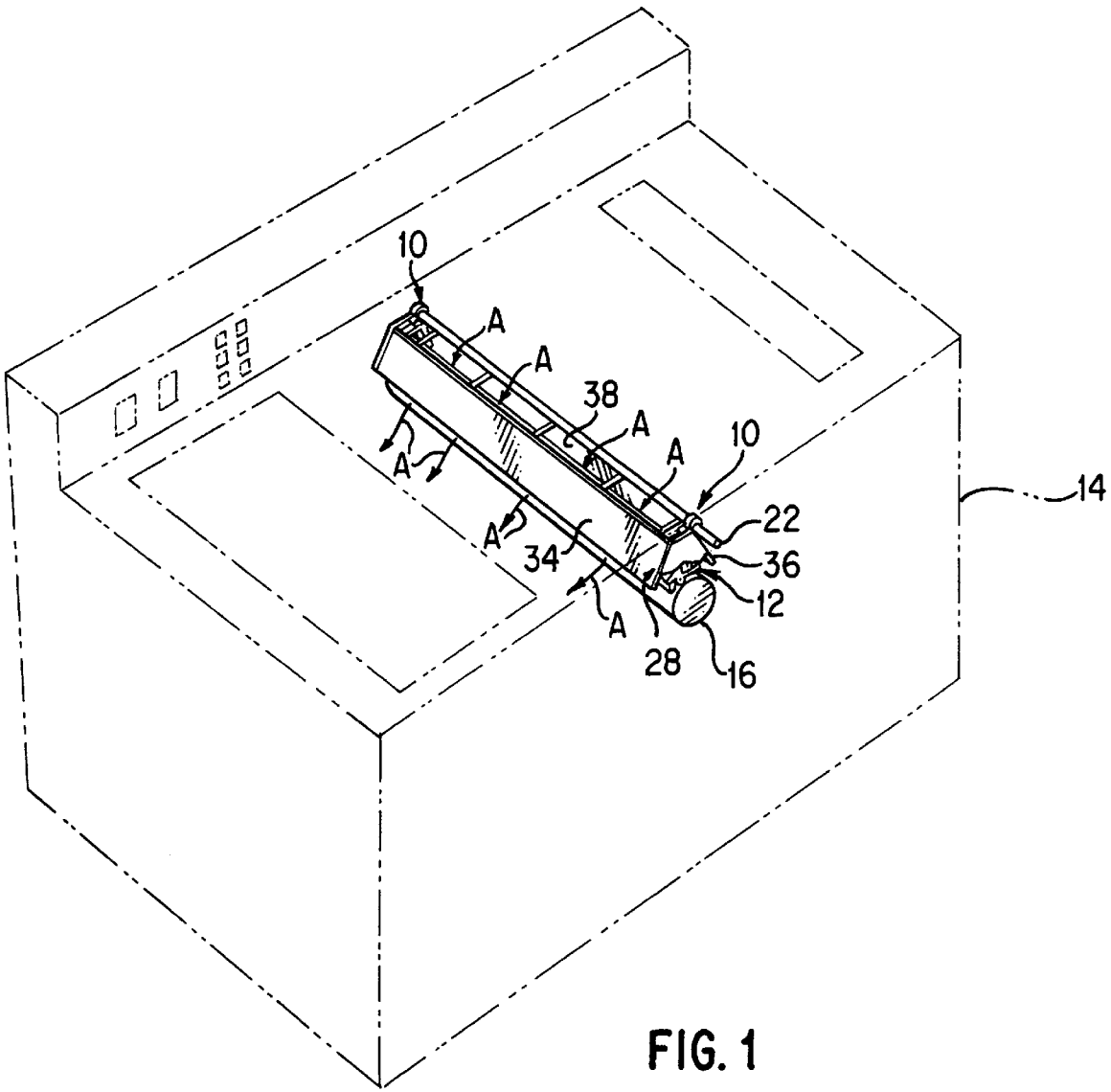
FIG. 1 is a perspective view of an imaging module mounting structure of the invention installed in a conventional imaging device drawn in phantom.
Figure 2:
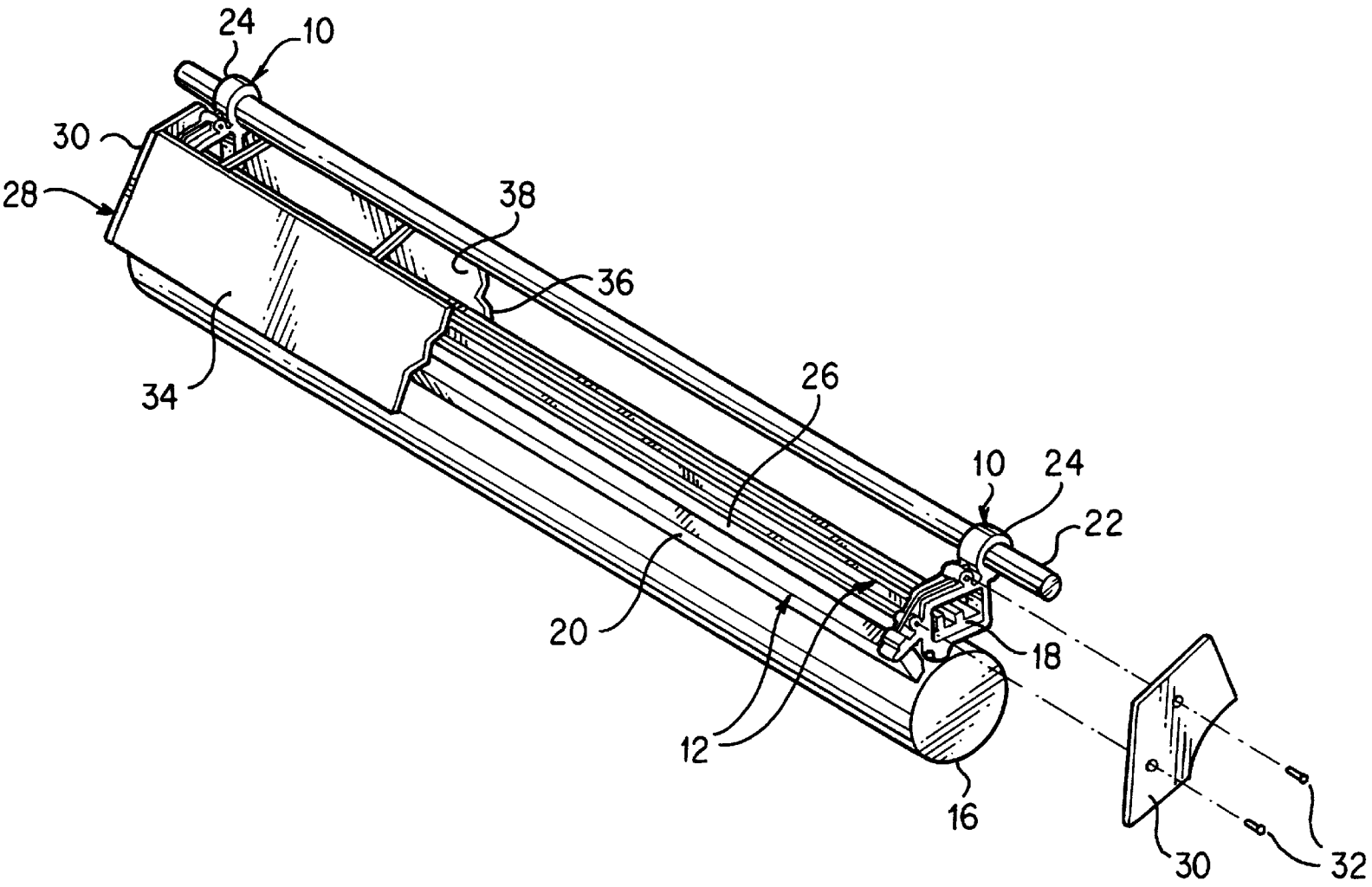
FIG. 2 is a perspective view partially broken away of the imaging module mounting structure of the invention in FIG. 1.

An imaging module mounting structure 10 of the invention is generally introduced in FIGS. 1 and 2. The imaging module mounting structure 10 of the invention is used for mounting an imaging module 12 to an imaging device 14. The imaging device 14 is a typical electrostatographic image forming device, such as a photocopier, a laser printer, a facsimile machine, a digital copier and the like that uses a drum-type photoreceptor 16 that, when operative, rotates inside the imaging device 14 as shown in FIG. 1. With reference to FIG. 2, the imaging module 12 includes an imaging bar 18 and a corona generating device 20. The imaging device 14 has a support member 22 that is connected inside the imaging device 14 for supporting the imaging module mounting structure 10 of the invention.

The imaging module mounting structure 10 of the invention includes a pair of pivot block devices 24 that are pivotably connected to the support member 22 in a spaced-apart relationship as shown in FIG. 2. The imaging bar 18 and a corona generating device 20 are secured to each one of the pair of pivot blocks 24. The imaging bar 18 and the corona generating device 20 are secure to the pair of pivot block devices 24 in an arrangement to form a plenum 26 in the imaging module 12. The imaging module mounting structure 10 also includes a housing 28 that is connected to the pair of pivot block devices 24 by a pair of oppositely-disposed end plates 30 by screws 32. The housing 28 also includes a front panel 34 and a rear panel 36. The housing 28 surrounds the imaging bar 18 and the corona generating device 20 to define an air inlet duct 38 into the plenum 26. The air inlet duct 38 permits air shown by arrows A in FIG. 1 to enter into the housing 28 and flow through the plenum 26 in order to provide convectional cooling of both the imaging bar 18 and the corona generating device 20. Also, the air flow through the housing 28 exhausts the ozone generated by the corona generating device 20.

Figure 3:
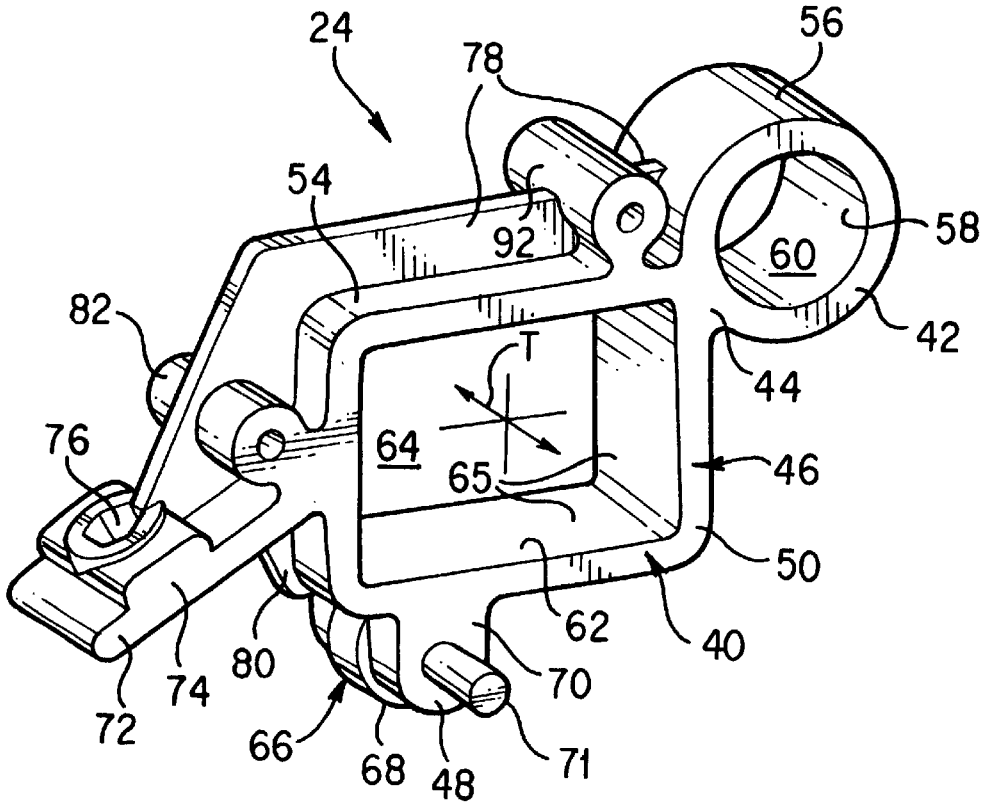
FIG. 3 is a perspective view of a first embodiment of a pivot block device of the invention.
Figure 4:
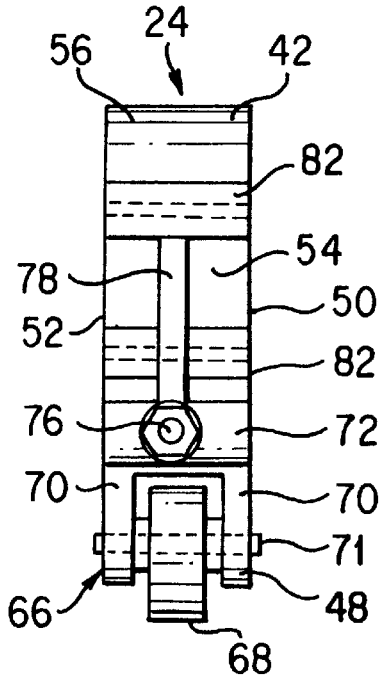
FIG. 4 is a front elevational view of the first embodiment of the pivot block device of the invention shown in FIG. 3.

A first embodiment of the pivot block device 24 is generally illustrated in FIGS. 3 and 4. The pivot block device 24 includes a cam follower assembly 40, a connector member 42 and a web 44. Although not by way of limitation, the connector member 42 is illustrated as a sleeve.

The cam follower assembly 40 includes a body member 46 and a cam follower element 48. The body member 46 has a first surface 50, a second surface 52 that is disposed opposite of the first surface 50 and an outer wall 54 that extends between the first and second surfaces 50 and 52 respectively in a transverse direction shown by arrow T. The outer wall 54 also extends circumferentially about the first and second surfaces 50 and 52. The cam follower element 48 is connected to and projects from the outer wall 54.

The connector member 42 has an outer connector surface 56 and an inner connector surface 58 that defines a conduit 60. The web 44 is disposed apart from the cam follower element 48 and interconnects the body member 46 and the connector member 42 at the outer wall 54 and the outer connector surface 56. In this manner, the connector member 42 is connected to the cam follower assembly 40 such that the conduit 60 extends in the transverse direction T.

Figure 5:
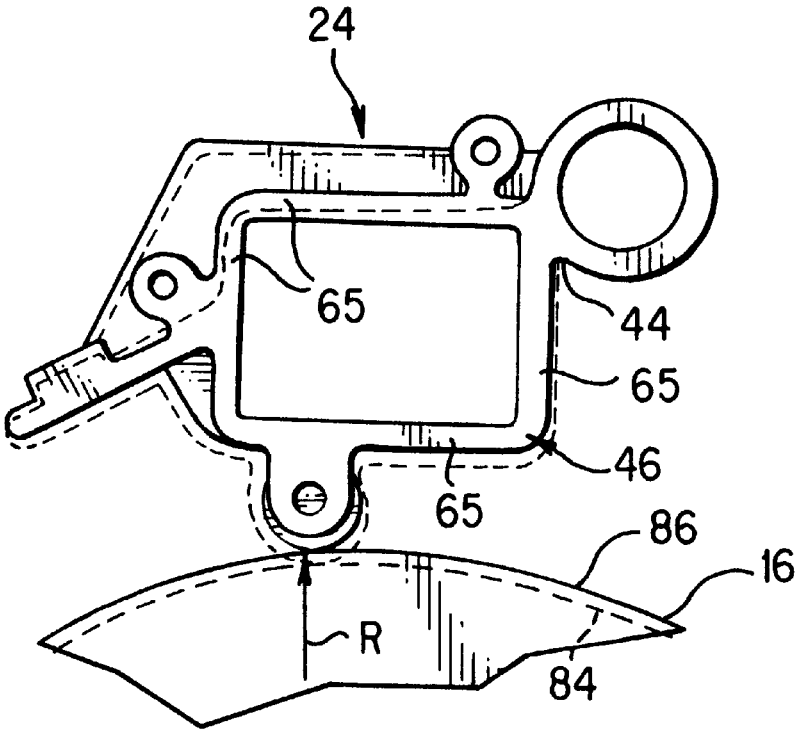
FIG. 5 is a side elevational view of the first embodiment of the pivot block device of the invention flexed about a web when run out of a photoreceptor increases.

For the first embodiment of the pivot block device 24 of the invention, the body member 46 includes an inner wall 62 that extends between the first and second surfaces 50 and 52 and interiorly of the first and second surfaces 50 and 52 to define an opening 64 that extends through the body member 46 in the transverse direction T. As best shown in FIG. 5, the body member 46 includes four segments 65 that are connected together to form a generally rectangular cross-sectional configuration. Interiorally of the four connected segments 65, the opening 64 is formed that extends through the body member 46. For the first embodiment of the pivot block device 24, the cam follower element 48 is disposed on one segment while the web 44 is disposed on a remaining one of the segments. Specifically, the remaining one of the segments is connected to the one segment on which the cam follower element 48 is disposed.

Figure 6:
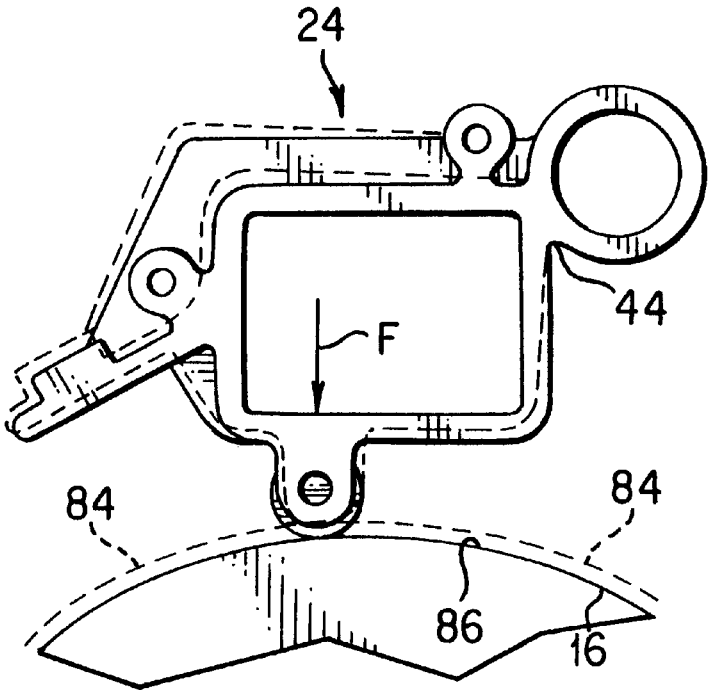
FIG. 6 is a side elevational view of the first embodiment of the pivot block device of the invention shown flexed about the web when run out of the photoreceptor device decreases.

For the first embodiment of the pivot block device 24 of the invention in FIGS. 5 and 6, the cam follower element 48 includes a roller assembly 66. The roller assembly 66 includes a cylindrically-shaped roller 68 that is mounted for rotation between a pair of roller support members 70 by a dowel 71.

Additionally, the first embodiment of the pivot block device 24 of the invention, includes a mounting member 72 that is disposed apart from the connector (or sleeve) member 42 and the cam follower element 48. Specifically, although not by way of limitation, the mounting member 72 is disposed forward of both the connector member 42 and the cam follower element 48 and is connected to and projects from the outer wall 54. The mounting member 42 is sized and adapted for mounting the corona generating device 20 in a secured manner onto each pivot block device 24. The mounting member 72 includes a plateau portion 74 having a hole 76 formed therethrough. However, it should be appreciated that the mounting member 72 can have other shapes and other locations on the pivot block device depending on the particular image forming device.

Also, a first rib 78 is connected to and projects from the outer wall 54 at an upper portion of the cam follower assembly and the mounting member 72. A second rib 80 is connected to an underneath portion of the mounting member 72 and an adjacent portion of the outer wall 54. Although not by way of limitation, a pair of side panel mounts 82 are connected to the outer wall 54 and the first rib 78 as best shown in FIG. 3. One side panel mount 82 is disposed adjacent the web 44 while the other side panel mount 82 is disposed adjacent the mounting member 72.

Figure 7:
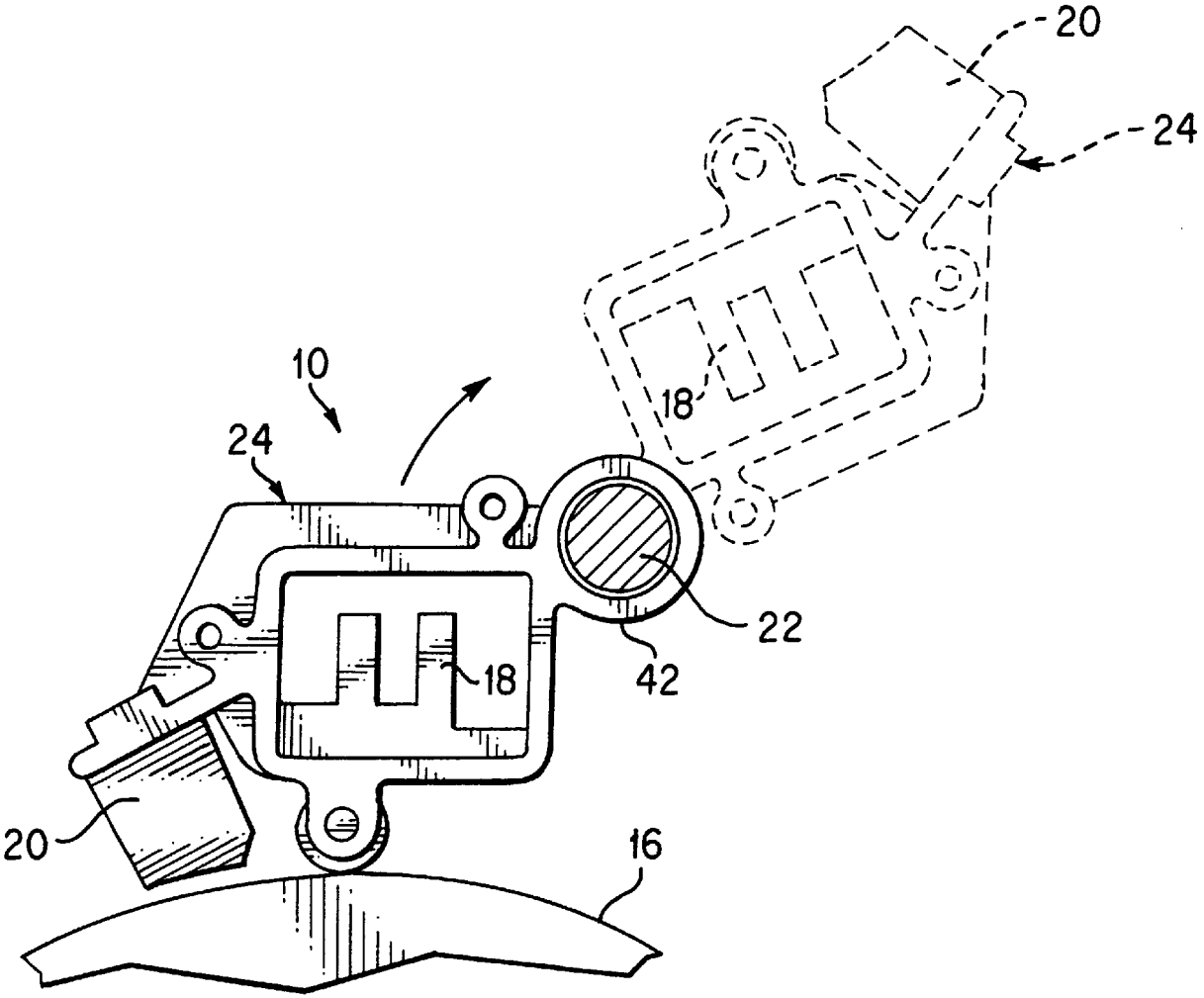
FIG. 7 is a side elevational view of the first embodiment of the pivot block device in contact with the photoreceptor in a first state and pivoted away from the photoreceptor in a second state drawn in phantom.

FIGS. 5 and 6 illustrate how the pivot block device operates in order to compensate for photoreceptor run out. An arcuate line 84 represents a perfectly circular configuration of the drum-type photoreceptor 16, i.e., a photoreceptor having no eccentricity. However, with the photoreceptor 16 having a run out of approximately plus or minus 0.006 inches, each one of the pair of pivot block devices 24 that form the imaging module mounting structure 10 of the invention flexes about the web 44 in order to compensate for the photoreceptor run out. In FIG. 5, a rise of the photoreceptor run out illustrated by arrow R which is caused by a rising photoreceptor surface 86 causes the pivot block device 24 to flex in an upwardly direction to compensate for the rising photoreceptor run out. In FIG. 6, a fall of the photoreceptor run out is illustrated. Arrow F shows the pivot block device 24 flexing downwardly in the direction of arrow F which is caused by the weight of the imaging bar and corona generating device (shown in FIGS. 1 and 2). With reference to FIGS. 1, 2 and 7, each pivot block device is mounted to a cylindrical support member 22. The connector member 42 is formed in a shape of a cylinder or sleeve that can rotate about the cylindrical support member 22 and permits the imaging module mounting structure 10 to pivot away from the photoreceptor 16 in the manner shown in FIG. 7. Pivoting the imaging module mounting structure 10 away from the photoreceptor 16 allows easy assess to the imaging bar 18 and the corona generating device 20 for cleaning, failure analysis and easy replacement of maintenance items.

Figure 8:
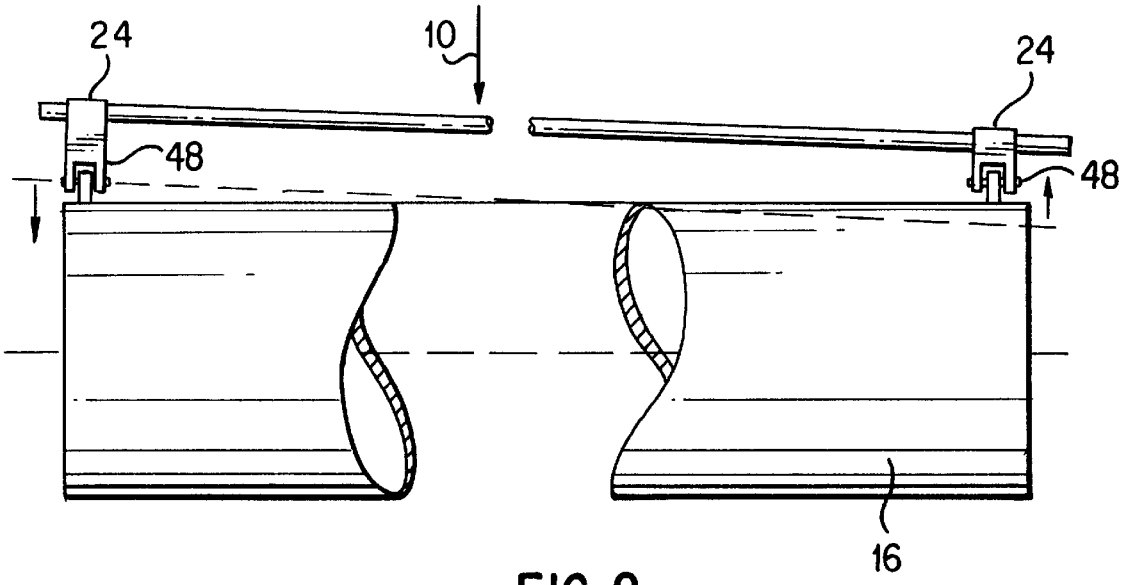
FIG. 8 is a front elevational view showing a pair of the first embodiments of the pivot block devices in contact with the photoreceptor having run out.

FIG. 8 illustrates that the pair of pivot block devices 24 that form the imaging module mounting structure 10 of the invention are operative to flex independently of one another while the photoreceptor 16 rotates. One pivot block device 24 flexes to compensate for the rise of photoreceptor run out as shown at a right-handed portion of FIG. 8. The pivot block device 24 on a left-side of FIG. 8 flexes downwardly to compensate for the fall of the photoreceptor run out. Thus, the cam follower element 48 remains in contact with the rotating photoreceptor 16. One of ordinary skill in the art would appreciate that FIG. 8 is used to demonstrate both the rise and the fall of the photoreceptor run out and that because the pivot block devices 24 flex independently of one another, both of the pivot block devices 24 can compensate for the photoreceptor run out regardless of where the rise and fall occur.

Figure 9:
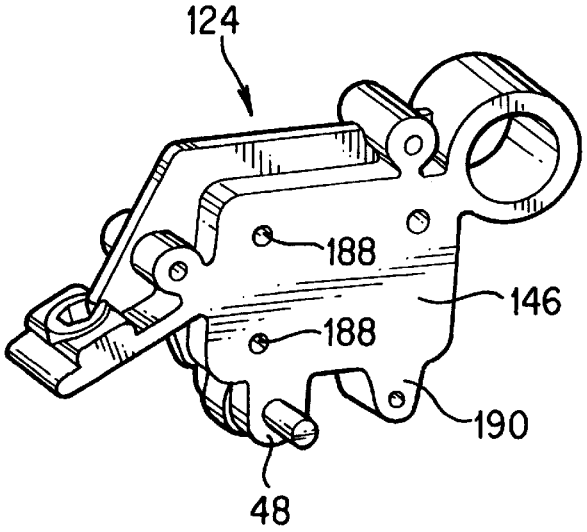
FIG. 9 is a perspective view of a second embodiment of the pivot block device of the invention.

A second embodiment of the pivot block device 124 is shown in FIG. 9. The second embodiment of the pivot block device 124 is substantially similar to the first embodiment 24. However, a body member 146 of the pivot block device 124 is substantially a solid piece without the opening 64 of the first embodiment. However, the body member 146 includes mounting holes 188 that can be used to secure either the end plates 30 or the imaging bar 18 and the corona generating device 20.

Also, the pivot block device 124 includes a mounting element 190 that is disposed behind and adjacent to the cam follower element 48. Although not by way of limitation, the mounting element 90 can be used for securing other components of the imaging module such as an electrostatic voltmeter (not shown).

Figure 10:
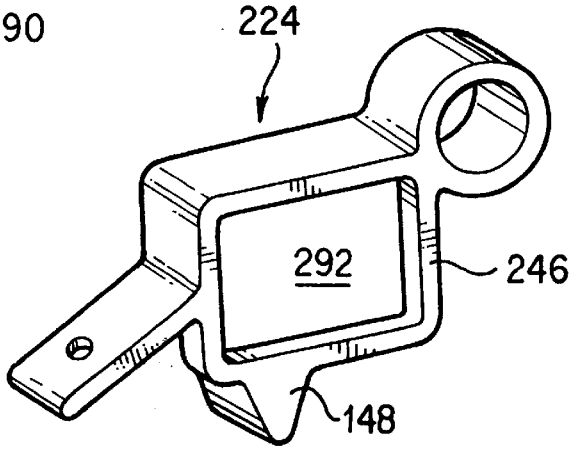
FIG. 10 is a perspective view of a third embodiment of the pivot block device of the invention.

A third embodiment of the pivot block device 224 is shown in FIG. 10. The third embodiment of the pivot block device 224 is similar to the first and second embodiments of the pivot block device 24 and 124 respectively. However, the pivot block device 224 includes a recess 292 formed into a body member 246. Also, a cam follower element 148 is a protuberance as opposed to the roller assembly 66 as described in FIGS. 3 and 4.

One of ordinary skill in the art would appreciate that the pivot block devices of the invention described herein are fabricated from a stiff yet resilient material. Specifically, the stiff yet resilient material is a plastic. With such a material, the cam follower assembly and the connector member are operative to pivot relative to each other about the web.

Figure 11:
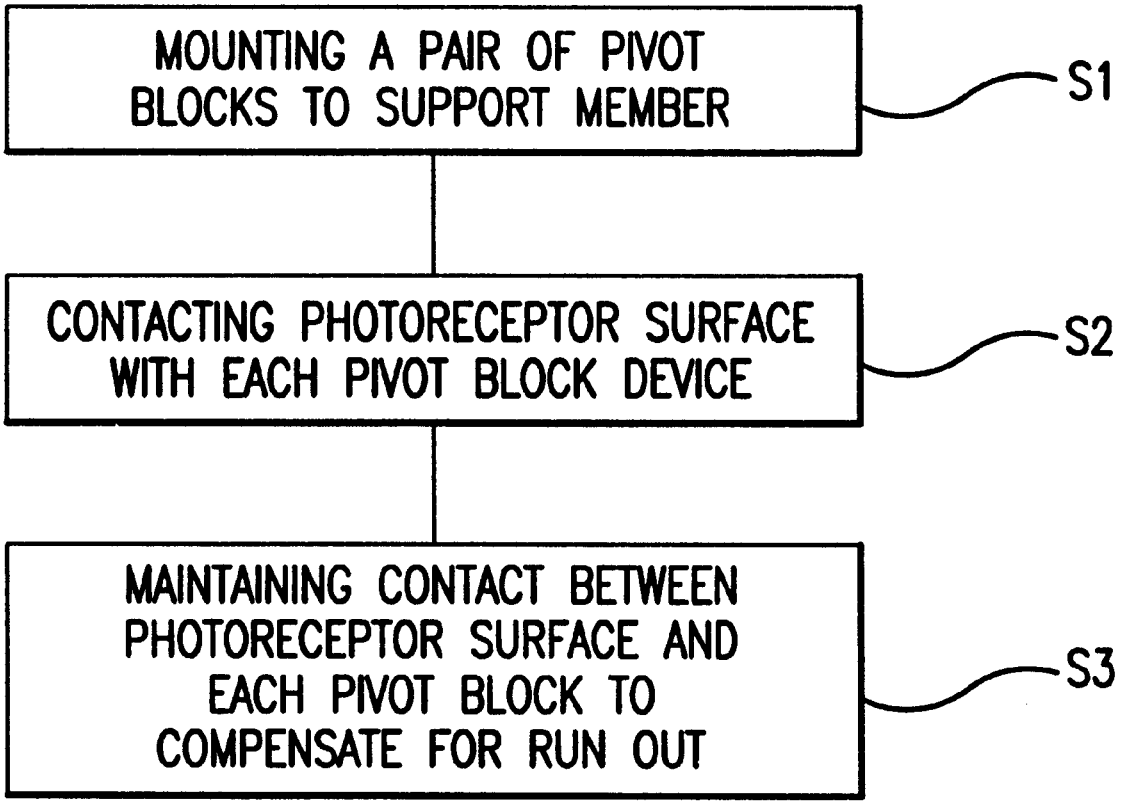
FIG. 11 is a flowchart implementing a method for practicing the invention.

A method for practicing the invention is shown in FIG. 11. The method retains the imaging module used in the imaging device in contact with the photoreceptor as the photoreceptor rotates. Step S1 mounts each one of the pair of pivot block devices to the support member. Step S2 contacts the photoreceptor surface of the rotating photoreceptor with each one of the pair of pivot block devices. Step S3 maintains contact between each one of the pair of pivot block devices and the photoreceptor surface so that each one of the pair of pivot block devices flexes independently of one another as the photoreceptor rotates to compensate for photoreceptor run out.

The invention has been described with particularity in connection with the embodiments. However, it should be appreciated that changes may be made to the embodiments of the invention without departing from the spirit and inventive concepts contained herein.

What is claimed is:

1. A pivot block device, comprising:

a cam follower assembly including a body member having a first surface, a second surface disposed opposite the first surface and an outer wall extending between the first and second surfaces in a transverse direction and circumferentially about the first and second surfaces and a cam follower element connected to and projecting from the outer wall;

a connector member having an outer connector surface and an inner connector surface defining a conduit; and a web disposed apart from the cam follower element and interconnecting the body member and the connector member at the outer wall and the outer connector surface such that the conduit extends in the transverse direction.

2. A pivot block device according to claim 1, wherein the body member includes an inner wall extending between and interiorly of the first and second surfaces to define an opening extending through the body member in the transverse direction.

3. A pivot block device according to claim 1, wherein the body member includes a recess formed into the body member from at least one of the first and second surfaces.

4. A pivot block device according to claim 1, further comprising a mounting member disposed apart from the connector member and the cam follower element, the mounting member connected to and projecting from the outer wall.

5. A pivot block device according to claim 1, wherein the cam follower assembly and the connector member are operative to pivot relative to each other generally about the web.

6. A pivot block device according to claim 1, wherein the cam follower element is one of a roller assembly and a protuberance.

7. A pivot block device according to claim 1, wherein the connector member is formed in a shape of a cylinder.

8. A pivot block device according to claim 1, wherein at least the web is fabricated from a stiff yet resilient material.

9. A pivot block device according to claim 8, wherein the stiff yet resilient material is plastic.

10. A pivot block device according to claim 1, wherein the body member includes four segments connected together to form a generally rectangular cross-sectional configuration having an opening extending through the four connected segments.

11. A pivot block device according to claim 10, wherein the cam follower element is disposed on one segment and the web is connected to a remaining one of the segments.

12. A pivot block device according to claim 11, wherein the remaining one of the segments is connected to the one segment on which the cam follower element is disposed.

13. An imaging module mounting structure for mounting an imaging module to an imaging device having a support member and a rotatable photoreceptor, the imaging module including an imaging bar and a corona generating device, the imaging module mounting structure comprising:

a pair of pivot block devices pivotably connected to the support member in a spaced apart relationship with the imaging bar and the corona generating device secured to each one of the pair of pivot block devices, each one of the pivot block devices including a cam follower element wherein the pair of pivot block devices are operative to flex independently of one another while the photoreceptor rotates so that the cam follower elements remain in contact with the rotating photoreceptor.

14. An imaging module mounting structure according to claim 13, wherein each one of the pair of pivot block devices includes a body member, a sleeve member and a web, the body member having a first surface, a second surface disposed opposite the first surface and an outer wall extending between the first and second surfaces in a transverse direction and circumferentially about the first and second surfaces with the cam follower element connected to and projecting from the outer wall, the sleeve member having an outer sleeve surface and an inner sleeve surface defining a conduit, the web disposed apart from the cam follower element and interconnecting the body member and the sleeve member at the outer wall surface and the outer sleeve surface such that the conduit extends in the transverse direction, wherein each one of the pair of pivot block devices flex substantially about the web.

15. An imaging module mounting structure according to claim 14, wherein the body member includes an inner wall extending between and interiorly of the first and second surfaces to define an opening extending through the body member in the transverse direction wherein the opening is sized such that each one of the pivot block devices receives a respective end portion of the imaging bar through the opening.

16. An imaging module mounting structure according to claim 15, wherein each one of the pivot block devices includes a mounting member disposed apart from the sleeve member and the cam follower element, the mounting member connected to and projecting from the outer wall and sized and adapted for mounting the corona generating device thereon.

17. An imaging module mounting structure according to claim 13, wherein the imaging bar and the corona generating device are secured to the pair of pivot block devices to form a plenum in the imaging module.

18. An imaging module mounting structure according to claim 17, further comprising a housing connected to the pair of pivot block devices and surrounding the imaging bar and the corona generating device to define an air inlet duct into the plenum.

19. An imaging module mounting structure according to claim 13, wherein each one of the pair of pivot block devices includes a mounting element disposed adjacent the cam follower element.

20. A method for retaining an imaging module used in an imaging device in contact with a photoreceptor as the photoreceptor rotates, the imaging module including a pair of spaced apart pivot block devices and the imaging device including a support member, the method comprising the steps of:

mounting each one of the pair of pivot block devices to the support member;

contacting a photoreceptor surface of the rotating photoreceptor with each one of the pair of pivot block devices; and maintaining contact between each one of the pair of pivot block devices and the photoreceptor surface wherein each one of the pair of pivot block devices flexes independently of one another as the photoreceptor rotates to compensate for photoreceptor run out.

* * * * *